US005837406A

United States Patent [19]

Tavernier et al.

[11] Patent Number: 5,837,406

[45] Date of Patent: Nov. 17, 1998

[54] TONER IMAGE RESISTANT TO SCRATCHING

[75] Inventors: Serge Tavernier, Lint; Stefaan De Meutter, Antwerp; Danny Van Wunsel, Nijlen, all of Belgium

[73] Assignee: AGFA-Gevaert, N.V., Mortsel, Belgium

[21] Appl. No.: 859,721

[22] Filed: May 21, 1997

[30] Foreign Application Priority Data

May 21, 1996 [EP] European Pat. Off. ..... 96201373

[60] Provisional application No. 60/021,969 Jun. 27, 1996.

[51] Int. Cl.[6] ..... G03G 13/20

[52] U.S. Cl. ..... 430/12; 430/124; 399/342

[58] Field of Search ..... 430/12, 66, 124; 427/261, 265; 399/333, 342

[56] References Cited

U.S. PATENT DOCUMENTS

| | | | |
|---|---|---|---|
| 4,795,689 | 1/1989 | Matsubara et al. | 430/110 |
| 4,869,921 | 9/1989 | Gabel et al. | 427/14.1 |
| 5,339,146 | 8/1994 | Aslam et al. | 355/285 |

FOREIGN PATENT DOCUMENTS

| | | |
|---|---|---|
| 0 081 887 | 6/1983 | European Pat. Off. . |
| 0 486 235 | 5/1992 | European Pat. Off. . |
| 0 588 280 | 3/1994 | European Pat. Off. . |
| WO 88/01205 | 2/1988 | WIPO . |

OTHER PUBLICATIONS

Patent Abstracts of Japan, vol. 8, No. 245 (P–312) (1682), Nov. 10, 1984 re JP–A–59 119364 (Fuji Xerox), Jul. 10, 1984.

*Primary Examiner*—John Goodrow
*Attorney, Agent, or Firm*—Breiner & Breiner

[57] ABSTRACT

A toner image, comprising a plurality of fused different types of toner particles on a substrate is provided wherein on top of the image, optionally comprising a clear finish layer, an abhesive compound is present in an amount between 3.0 and 300 mg/m$^2$ and wherein the abhesive compound has a viscosity, at 25° between 50 and 50,000 mPas. A method and an apparatus for providing such a toner image, resistant to scratching are also provided.

20 Claims, No Drawings

TONER IMAGE RESISTANT TO SCRATCHING

This application claims the benefit of U.S. Provisional Application No. 60/021,969, filed 06/27/96.

FIELD OF THE INVENTION

This invention relates to an electrostatographic imaging method. In particular this invention relates to a method to improve the mechanical properties of fixed toner images comprising several superimposed toner layers.

BACKGROUND OF THE INVENTION

Electrostatic printing methods are manifold, e.g. Direct Electrostatic Printing, wherein electrostatic printing is performed directly from a toner delivery means on a receiving substrate, the latter not bearing any imagewise latent electrostatic image, by means of an electronically addressable printhead structure.

In another form of electrostatic printing toner images are made on an image-forming element in the form of a rotating drum provided with an electrostatic layer built up from a number of controllable electrodes in and beneath a dielectric layer. The voltage that is image-wise applied to said controllable electrodes attracts charged toner particles from a toner source.

It is also well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light absorbing particles, called toner particles, which usually are triboelectrically charged.

In magnetography a latent magnetic image is formed in a magnetizable substrate by a pattern wise modulated magnetic field. The magnetizable substrate must accept and hold the magnetic field pattern required for toner development which proceeds with magnetically attractable toner particles.

In toner development of latent electrostatic images two techniques have been applied : "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, Apr. 1972, pp.495–511.

In the case of direct printing technologies, the toning developer is directly, image wise deposited on a final substrate to form a visible image. In the case of indirect printing methods a latent image, electrostatic or magnetographic, is developed to form a visible image. This visible image is the transferred, either directly or via an intermediate transfer medium, to a final substrate. In any case, the visible image of electrostatically or magnetically attracted toner particles, on the final substrate, is not permanent and has to be fixed by causing the toner particles to adhere to each other and the substrate by softening or fusing them followed by cooling. Normally fixing proceeds on more or less porous paper by causing or forcing the softened or fused toner mass to penetrate into the surface irregularities of the paper.

Dry-development toners essentially comprise a thermoplastic binder consisting of a thermoplastic resin or mixture of resins (ref. e.g. U.S. Pat. No. 4,271,249) including colouring matter, e.g. carbon black or finely dispersed dye pigments or soluble dyes. The triboelectrically chargeability is defined by said substances and may, optionally, be modified with a charge controlling agent.

The toner image fixed to a substrate is vulnerable and can e.g. easily be scratched. Especially full colour images or black and white images wherein the tonal range is extended by the use of toner particles comprising different amounts of black pigment, are vulnerable, due to the height differences in the images. These height differences occur because of the superposition of various layers of toner particles depending on the colour hue or to the grey density that has to be reproduced. This "surface relief" enhances the possibility for mechanical scratches to occur in the image. It has been disclosed to apply a layer of colourless toner particles on top of the four colour toner image to protect the image and at the same time equalize the gloss of the image. Typical examples of such layers and different ways to apply such a layer are disclosed in, e.g., EP-A 629 921, EP-A 486 235, U.S. Pat. No. 5,234,783, U.S. Pat. No. 4,828,950, EP-A 554 981, WO 93/07541 and Xerox Research Disclosure Journal, Vol.16, $N^0$ 1, p. 69 (January/February 1991).

In WO 88/01205 it is disclosed to apply a powdered TEFLON (trade name) fluorocarbon as protective coating on a toner image. The application of a powdered compound on such a toner image is however not very straightforward. This application states that it is believed that other fluid compounds (e.g. waxes, silicone oil) can beneficially be used, but fails to indicate on what results this believe is founded.

It was however found that the measures that have been disclosed do indeed yield an improvement in mechanical scratchability, such that the image is no longer easily scratched away, but that the scratches were still visible under some angles of illumination. This seems to be a kind of gloss difference or difference in height of the image.

There is thus still need for toner images that do not show that drawback and for a method to make images not showing the drawbacks enumerated above.

OBJECTS AND SUMMARY OF THE INVENTION

It is an object of the invention to provide toner images, fixed on a final substrate, that are not only not mechanically scratched such that the toner particles are detached from the substrate or smeared out on the surface, but that do not show scratches whatever the angle of illumination.

It is a further object of this invention to provide multicolour toner images, fixed on a final substrate, with or without a special top layer of toner particles, that are not only not mechanically scratched such that the toner particles are detached from the substrate, but that do not show scratches whatever the angle of illumination.

It is an other object of the invention to provide a method and an apparatus for producing multi-colour toner images, with or without a special top layer of toner particles, that are not only not mechanically scratched such that the toner particles are detached from the substrate, but that do not show scratches whatever the angle of illumination.

Further objects and advantages of the invention will become clear from the detailed description of the invention hereinafter.

The objects of the invention are realized by providing a toner image fixed on a final substrate characterized in that i) said toner image comprises a plurality of fused different types of toner particles and ii) said toner image comprises on top of it a non-image wise applied layer of an abhesive compound, said abhesive compound being present in an amount between 3.0 mg/m$^2$ and 300 mg/m$^2$ and having a viscosity at 25° C. between 50 and 50,000 mPas.

In a preferred embodiment said toner image comprises on top of said a plurality of fused different types of toner particles a clear fused toner layer as clear finish layer and said abhesive compound is present on top of said clear finish layer.

DETAILED DESCRIPTION OF THE INVENTION

Toner images, fixed to a final substrate, often show a "surface relief", i.e. differences in height between different parts of the image. This is especially so in full colour images were different colours and hues are realized by the superposition of yellow, magenta, cyan and black (YMCK) toners. In such an image, the yellow parts are e.g. made up by one layer of toner particles and the black parts by the superposition of four layers of toner particles. This gives raise to differences in height in the image, further on referred to as "surface relief". In European Application 95202768, filed on Oct. 13, 1995 it is disclosed to extend the grey scale (tonal range) in a black and white electrostatographic image fixed to a final substrate, by realizing the necessary different shades of grey with the superposition of toner particles comprising different amounts of black pigment. Also in these black and white images a surface relief is present. Toner images fixed on a final substrate and having a "surface relief" are quite sensitive to scratches, both to mechanically scratches such that the toner particles are detached from or smeared over the final substrate, and to scratches that are only visible under some angles of illumination.

Hereinafter the terms "scratchability" and "scratches" will refer both to mechanically scratches such that the toner particles are detached-from or smeared over the final substrate, and to scratches that are only visible under some angles of illumination.

When such an image comprises at its surface a certain amount of abhesive compound, the resistance to scratches was greatly enhanced. It showed that the non-image wise application of a layer of an abhesive compound, on top of a toner image showing "surface relief", in an amount of between 3.0 mg/m$^2$ and 300 mg/m$^2$, largely decreased the scratchability of the image. An amount lower than 3.0 mg/m$^2$ did not provide a decrease of scratchability and an amount higher than 300 mg/m$^2$ did change to much the glossiness and depending on the nature of abhesive compound showed an oily surface and/or a tacky surface. The best results, i.e. the best compromise between scratchability and oily and/or tacky surface of the toner image were reached when the abhesive compound was applied on top of the image in an amount of between 30 and 150 mg/m$^2$.

In order to protect a toner image showing "surface relief" it has been proposed, as disclosed herein above, to apply, mostly non-image wise, a clear layer of clear toner particles (i.e. a clear finish layer) on top of the fused toner layers, forming the image. The word "clear" means herein not giving, in a wavelength range extending from 400 to 700 nm, a visible density, said visible density being defined as less than 15% light reduction integrated over that wavelength range. By applying such a layer to the image, it is protected and at the same time the gloss of the image is more or less equalized. The image is indeed no longer easily scratched away, but that the scratches were still visible under some angles of illumination. This seems to be a kind of gloss difference or difference in height of the image. It was found that the scratchability of an image having a finish layer on top of it, could also be decreased, almost to zero, by applying, on top of the finish layer an abhesive compound in amounts as described above. A finish layer, applied on top of fused image-forming toner layers, is preferably formed by depositing, on top of the toner particles forming the image, a layer of toner particles having a lower meltviscosity than pigmented toner particles forming the image. This provision entails that the meltviscosity of the clear toner particles forming the clear finish layer is between 50 and 2000 Pas, preferably between 100 and 1000 Pas. All melt viscosities mentioned herein are measured in a RHEOMETRICS dynamic rheometer, RVEM-200 (One Possumtown Road, Piscataway, N.J. 08854 USA). The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. Due to the lower meltviscosity, said toner particles forming the finish layer interpenetrate, during the fixing process, easily with the toner particles forming the image. Due to this good interpenetration an even and uninterrupted finish layer is provided. On such a finish layer, however, scratches that are only visible under certain angles of illumination are still quite easily formed. Therefore the application of said abhesive compound, with the viscosity and in the amounts as specified above, is also in this case beneficial.

Even when the clear finish layer is applied in such a way that the surface relief is equalized, the scratchability of the image was not fully suppressed and application of an abhesive compound, with the viscosity and in the amounts as specified above, on top of the image did still provide an essential improvement in the resistance of the image against scratches. The clear finish layer equalizes the "surface relief" of the image when it is applied "counter image-wise", such that a thicker fixed clear finish layer is present in the lower thickness areas of the image and a thinner fixed clear finish layer is present in the higher thickness areas of the image.

The abhesive compound can be any compound that has a melting point under Tg of the resins used as toner resin, provided that the viscosity is in the range described above. The abhesive compounds can be applied to the surface of the toner images either in pure form or from a solution or dispersion in an organic solvent or in water. The application in pure form or from a solution or dispersion in water is preferred.

Useful abhesive compounds in the present invention are block copolymers containing a low-energy block, which is abhesive, and a higher energy block. The higher energy block will readily be adsorbed to the toner layers and the low-energy block is kind of floating above the surface of the image and reducing the scratchability. Typical examples of such block copolymers are polyester or polyether modified polysiloxanes, e.g. a polyether modified dimethylpolysiloxane (BF 100, trade name of BYK Chemie, Germany) or a polyester modified dimethylpolysiloxane (BF 111, trade name of BYK Chemie, Germany). When such abhesive compounds are used, the viscosity, to be used for characterizing the useful abhesive compounds of this invention, is the viscosity of the polysiloxane moiety of the block copolymer.

The abhesive compounds that are preferred in this invention are silicone oils. It found that the effect of the application of silicone oils as abhesive compound on top of a toner image was not much dependent on the chemical formula, but was quite sensitive to the viscosity of the oil. A silicone oil with a viscosity of 50 mPas at 25° C., when applied on top of a toner image, did reduce the scratchability of said image, but the effect did only last for 10 days. By using silicone oils with a viscosity between 2000 and 50,000 mPas, at 25° C., the decrease of scratchability lasted for at least 30 days. Therefore silicone oils with a viscosity at 25° C. between 2000 mPas and 50,000 mPas are preferred for use in the present invention, more preferred are silicone oils with a viscosity at 25° C. between 5000 mPas and 30,000 mPas. The silicone oils for use in the present invention can be any organic derivative of siloxane oils (e.g. polyphenylmethylsiloxane, polydimethylsiloxane, polydiphenylsiloxane, etc) and functional polyorganosiloxane oils such as mercapto-functional polyorganosiloxane, amino-functional polyorganosiloxane oils, hydroxy-functional polyorganosiloxane, fluorosilicone oils, etc.

In a preferred embodiment of the invention, at least one of said different types of toner particles comprises a toner resin containing reactive groups (A) and said abhesive compound comprises reactive groups (B) and reactive groups A and B are chosen such that they can react together forming a chemical bond between said fused toner particles and said abhesive compound. When using a clear finish layer, formed by the deposition an fusing of clear toner particles, said clear toner particles forming said finish layer comprise preferably a toner resin containing reactive groups (A) and said abhesive compound comprises reactive groups (B) and reactive groups A and B are chosen such that they can react together forming a chemical bond between said fused toner particles and said abhesive compound.

Said reactive groups A are preferably members selected from the group consisting of epoxy groups, amino groups, hydroxyl groups and carboxyl groups and wherein said reactive groups B are members selected from the group consisting of amino groups, mercapto groups, hydroxyl groups. Resins, for use as toner in toner particles according to the present invention, comprising reactive groups A can be homopolymers as well as copolymers. Typical examples are e.g. polymers (polycondensation polymers or addition polymers) having an acid or hydroxyl value≧2.5 mg KOH/g. Preferably said polycondenSation polymers are polyesters and said addition polymers comprise moieties carrying carboxylgroups (e.g. addition polymers comprising acrylic acid moieties). Typical examples of very useful polymers for toner resins used in toner particles according to this invention are tabulated in table 1. Of these resins the glass transition temperature Tg in °C. is given together with their number-average molecular weight (Mn) and weight-average molecular weight (Mw). The mentioned Mn and Mw values have to be multiplied by $10^3$ . The resins containing free carboxylic acid groups and or hydroxyl groups are characterized by their total acid value (AV) or Hydroxyl value (HV) both expressed in mg KOH per g resin.

Other useful polymers, comprising reactive groups A and useful in the present invention are epoxy resins (linear adducts of bisphenol compounds and epichlorhydrin as described e.g. by D. H. Solomon in the book "The Chemistry of Organic Film Formers" -John Wiley & Sons, Inc, New York (1967) p. 180–181,) e.g. EPIKOTE 1004 (EPIKOTE is a registered trade mark of the Shell Chemical Co.), polyamides, copolymers of polyester and polyamides, etc.

TABLE 1

| Nr | Chemical structure | AV | HV | Tg | Mn | Mw |
|---|---|---|---|---|---|---|
| P1 | Polyester resin of terephthalic acid, ethyleneglycol and DIANOL 22 | 3 | 31.1 | 62 | 3.6 | 10 |
| P2 | Polyester resin of fumaric acid and DIANOL 33 (ATLAC T500, trade name) | 17 | 5.2 | 55 | 4.4 | 12 |
| P3 | Polyester resin of terephthalic acid 40 mol %), isophthalic acid (60 mol %) and DIANOL 22 (40 mol %) and ethyleneglycol (60 mol %) | 18 | 20.9 | 60 | 4 | 18 |
| S1 | Copoly(styrene-butylacrylate-butylmethacrylate-stearylmethacrylate-methacrylic acid) (65/5/21/5/4) | 12 | 0 | 58 | 6 | 108 |
| S2 | Copoly(styrene-butylmethacrylate-acrylic acid (80/15/5) | 5 | 0 | 63 | 5.5 | 180 |
| P4 | Polyester resin of DIANOL 33/DIANOL 22, terephthalic acid and trimellitic acid | 30 | 50 | 65 | 2.0 | 14 |
| S3 | Co(Styrene/n-butylmethacrylate), diCOOH terminated (65/35) | 15 | 0 | 48 | 2.1 | 10 |

DIANOL 22 is a trade name of AKZO CHEMIE of the Netherlands for bis-ethoxylated 2,2-bis(4-hydroxyphenyl) propane. DIANOL 33 is a trade name of AKZO CHEMIE of the Netherlands for bis-propoxylated 2,2-bis(4-hydroxyphenyl)propane.

It is possible to incorporate in the clear toner particles very fine (diameter<1 μm) reactive particles e.g. metal-oxides or metal-carbonates, without rendering the toner particles "milky". When such a clear finish layer comprising such particles is present on the image, it is preferred to use a carboxyl group comprising polysiloxane as abhesive compound. By the reaction of the carboxyl groups of the polysiloxane with the metal oxide or carbonate particles in the finish layer, the abhesive compound is chemically bound to the image. By this chemical binding of the abhesive compound to the surface of the image, the decrease of the scratchability of the image, due to the presence of the abhesive compound, lasted for at least for 60 days.

The application of silicone oils to a toner image is well known in the art, when toner images are fixed by heat and pressure, e.g., by a hot roller pressure fusing device. On such a pressure roller silicone oil is mostly present to avoid hot-offset of the toner particles. The amount of silicone oil that has to be present on the hot pressure roller, to completely avoid hot-offset is rather high. Especially in the case of printing images with a clear finish layer, the amount of silicone oil present at the surface of the image, after contact fusing, is between 400 mg/m and 1600 mg/$m^2$. These high amounts are especially necessary when said finish layer is produced by toner particles having a low meltviscosity at 120° C. It has been explained above that it is highly desirable to use toner particles with low meltviscosity in the formation of a clear finish layer. Toner particles with low meltviscosity are very prone to hot-offset, and therefore in a contact fusing process high amounts of silicone oil have to be used. The necessary amounts are higher than the amount needed according to the present invention and result in producing an image with a too shiny and oily surface.

Therefore, when using hot contact fusing in the production of an image according to the present invention, means have to be provided in the printing apparatus to remove silicone oil from the fixed image. Non-contact fusing is often preferred for fixing colour toner images to a substrate. In the non-contact fusing process, there is no direct contact of the toner image with a solid heating body. Such non-contact fusing process includes a variety of embodiments, such as : (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp.

According to a particular embodiment of "non-contact" fusing the heat reaches the non-fixed toner image through its substrate by contacting the support at its side remote from the toner image with a hot body, e.g., a hot metallic roller. In the present invention, non-contact fusing by radiant heat, e.g., infrared radiation (IR-radiation), is preferred. When non-contact fusing is used for fixing a toner image according to the present invention, means have to be provided in the printing apparatus to apply silicone oil to the image.

It was found that the abhesive compounds that were useful in the present invention had to have a specified surface energy. This surface energy was measured according to DIN 53914 at 23° C. It was found that only when said surface energy, measured as described above, was lower than or equal to 30 mN/m the beneficial effects of the abhesive compound were present.

The invention includes also a method for producing toner images on a final substrate comprising, in consecutive order, the steps of:

i) applying, image wise, a plurality of layers of toner particles on a final substrate forming said toner image, ii) fixing said toner particles to said substrate, forming an image, and iii) applying to said image a layer of an abhesive compound in an amount between 3.0 mg/m2 and 300 mg/m2, said abhesive compound having a viscosity at 25° C. between 50 and 50,000 mPas. In a further embodiment of this method, between the step of the image wise application of said plurality of layers of toner particles on a final substrate forming a toner image and the step of fixing said toner particles to said substrate a layer of clear toner particles is applied over the image.

The abhesive compound can also be applied on toner images, covered or not with a layer of clear toner particles, before fixing said toner particles and said toner particles are fixed after application of said abhesive compound.

The fixing step in the method described above can beneficially comprise a non-contact fusing step.

The methods, outlined above, are especially suited for the production of full colour images and black and white images wherein the different shades of grey are realized by the superposition of toner particles comprising different amounts of black pigment.

The invention also includes an apparatus for producing toner images comprising, in consecutive order :

i) means for image wise depositing a plurality of layers of different types of toner particles on a substrate, ii) means for fixing said toner image to said substrate and iii) means for applying on said toner image an abhesive compound in an amount between 3.0 mg/m2 and 300 mg/m2 said abhesive compound having a viscosity at 25° C. between 50 and 50,000 mPas.

An apparatus according to the present invention can also comprise, between said means for image wise depositing a plurality of layers of different types of toner particles on a substrate and means for fixing said toner image, means for applying a layer of clear toner particles, covering the previously applied layers.

Also an apparatus wherein said means for applying said abhesive compound precede said means for fixing said toner image, is within the scope of the present invention. An apparatus according to this invention and described immediately above, comprises beneficially means for non-contact fusing said toner particles.

Said means for applying said abhesive compound can be rollers, wicks, sprays, etc. When said means for applying silicone oils are rollers, it may be split rollers, e.g. when 100 $mg/m^2$ of silicone oil has to be applied, there may be provided four application rollers, the first two applying together 75 $mg/m^2$ of oil and the following rollers applying the remaining 25 $mg/m^2$ Preferred means for applying said abhesive compounds are supply rollers with a surface in NOMEX-felt (NOMEX is a trade name of Du Pont de Nemours, Wilmington, U.S.) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, U.S. 1995. The oils can be delivered to the image directly by supply rollers as described above, or over an intermediate roller, which distributes the oil even more evenly over the image.

Within this invention there is also provided an apparatus for producing toner images, comprising in the order given:

i) means for image wise depositing a plurality of layers of different types of toner particles on a substrate, ii) means for applying a layer of clear toner particles, covering said plurality of layers of toner particles, iii) means for fixing said toner image to said substrate by contact-fusing by an hot pressure roller, wherein silicone oil, having a viscosity at 25° C. between 50 and 50,000 mPas, is applied to said pressure roller and iv) means for adjusting, on said toner image, said silicone oil to an amount between 3.0 mg/m2 and 300 mg/m2.

Said means for adjusting said silicone oil may be means for removing silicone oil from the surface of the image and can be a brush, blotting means (paper, cloth, etc), etc, can be in roll form or a flat device. When said adjustment of said silicone oil needs further application of silicone oil the application means described above can also be used.

In order to control the gloss in an image treated with an abhesive product according to the present invention and fixed in a non-contact fusing process, it may be beneficial to add post- treatment of the fixed image (i.e. the fused toner particles), with a pressure roller in order to further uniformize the image. The pressure roller exerts preferably a pressure, per linear nip-length, on the fixed image of between 100 N/m and 500 N/m, and the post-treatment proceeds for a time preferably between 30 and 150 msec. There are, according to the present invention, two modes of operating said post-treatment. Said two modes differ in the temperature of said post-treatment. In a first mode the almost cold, having been allowed to cool after leaving the non-contact fusing station, fused image is passed through rollers said rollers having a temperature between 20° C. below and 20° C. above the softening temperature of the toner resin, which means in most cases a temperature of around 120° C. In a second mode of operation, the fused image is directly, without allowing it to cool, passed from the fusing station through a rollers, where essentially no additional heat is added to the fixed image, but where the temperature of the post-treatment rollers is kept between 5° C. below and 15° C. above the Tg of the toner resin. optionally, when necessary for good abhesivity between the fused image and the post-treatment rollers, it is possible to bring abhesive compounds, e.g. silicon oil, fluid waxes, etc, on the surface of the post-treatment rollers, with the provision that the total amount of abhesive compound present in the finished image is, within the range specified according to this invention.

The present invention can be practised on toner images that are formed with any electrographic imaging method and with any type of toner particles known in the are. The toner particles can be magnetic or non-magnetic. The developer used to form the image can be mono-component magnetic developer, a non-magnetic mono-component developer, a multi-component developer comprising non-magnetic toner particles and magnetic carrier particles.

The toner particles, used to form a toner image according to the present invention can comprise any known toner resin or mixtures thereof. The toner resin can be a polycondensation polymer or a mixture of different polycondensation polymers as well as an addition polymer or a mixture of addition polymers. Also mixtures of polycondensation polymers and addition polymers are suitable as toner resin for toner particles according to the present invention. When polycondensation polymers are used, the use of polyesters is preferred. Polyester resins suitable for use in toner particles according to the present invention are selected e.g. from the group of linear polycondensation products of (i) di-functional organic acids, e.g. maleic acid, fumaric acid, terephthalic acid and isophthalic acid and (ii) di-functional alcohols (diol) such as ethylene glycol, triethylene glycol, an aromatic dihydroxy compound, preferably a bisphenol such as 2,2-bis(4-hydroxyphenyl)-propane called "Bisphenol A" or an alkoxylated bisphenol, e.g. propoxylated bisphenol examples of which are given in U.S. Pat. No. 4,331,755. For the preparation of suitable polyester resins reference is made to GB-P 1,373,220. When addition polymers are used, it is preferred to use styrene/acrylic resins. Preferred styrene-acrylic resins have a relatively high (more than 70 mol %) styrene content, and are more particularly copolymers of styrene-acrylic resins or styrene-methacrylic resins, e.g copoly(styrene/n-butylmethacrylate) or copoly(styrene/2-ethyl-hexylacrylate).

Typical useful resins for the toner resin, in addition to the resins already disclosed in table 1, in toner particles according to the present invention are tabulated in table 2.

TABLE 2

| Polymer | Tg °C. | Meltviscosity Pas | $M_w$ | $M_n$ |
|---|---|---|---|---|
| Polyester P5 | 65 | 550 | 11,500 | 3,700 |
| Polyester P6 | 69 | 1,600 | 25,500 | 7,100 |
| Styr/acryl S4 | 67 | 1,700 | 33,000 | 13,000 |
| Styr/acryl S5 | 68 | 285 | 6,500 | 6,500 |
| Styr/acryl S6 | 78 | 169 | 19,000 | 7,000 |
| Styr/acryl S7 | 79 | 291 | 24,000 | 9,000 |
| Styr/acryl S8 | 79.5 | 698 | 36,000 | 13,500 |
| Styr/acryl S9 | 79 | 2252 | 60,500 | 23,000 |

Polyester P5 is an aromatic polyester resin derived from terephthalic acid (100 mol %) as aromatic diacid and a mixture of DIANOL 33 (50 mol %) and ethylene glycol (50 mol %) as diols. Polyester P6 is an aromatic polyester resin derived from terephthalic acid (64 mol %), isophthalic acid (36 mol %) as aromatic di-acids and ethylene glycol (100 mol %). Styr/acryl S4 is a copolymer of styrene and methyl acrylate in a 65/35 molar ratio.

Styr/acryl S5 is a terpolymer of styrene, methyl acrylate and dimethylaminoethyl methacrylate in a 87/3/10 molar ratio. Styr/acryl S6, S7, S8 and S9 are a copolymer of styrene and methyl acrylate in a 80/20 molar ratio, only differing in molecular weight.

The toner particles can comprise any normal toner ingredient e.g. charge control agents, pigments both coloured and black, dyes, release agents, resistivity regulating agents, anorganic fillers, etc. A description a charge control agents, pigments and other additives useful in toner particles, to be used in a toner composition according to the present invention, can be found in e.g. EP-A 601 235.

EXAMPLES

1. Preparation of the toner particles and the developers

Yellow toner (Y)

49 parts of polyester P2 of Table 1 and 49 parts of polyester P3 of Table 1 were melt-blended for 30 minutes at 110° C. in a laboratory kneader with 2 parts of SICOECHTGELB D 1355 DD (Colour Index PY 13, trade name of BASF AG, Germany).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume.

To improve the flowability of the toner mass the toner particles were mixed with 0.5 % of hydrophobic colloidal silica particles (BET-value 130 $m^2/g$).

Magenta Toner (M)

The preparation of the Yellow toner was repeated, but instead of 2 parts SICOECHTGELB PY13, 2 parts of PERMANENT CARMIN FFB 02 (Colour Index PR146, tradename of Hoechst AG, Germany) were used.

Cyan toner (C)

The preparation of the Yellow toner was repeated, but instead of 2 parts SICOECHTGELB PY13, 2 parts of HELIOGEN BLAU D7072DD (Colour Index PB15:3, trade name of BASF AG, Germany) were used.

Black toner (K)

The preparation of the Yellow toner was repeated, but instead of 2 parts SICOECHTGELB PY13, 2 parts of CABOT REGAL 400 (carbon black, trade name of the Cabot Corp. High Street 125, Boston, U.S.A.) were used.

The four toners, Y, M, C and K had a meltviscosity at 120° C. of 500 Pas.

Clear toner 1 (CLT1)

100 parts of polyester P2 of Table 1 were melt-blended for 30 minutes at 110° C. in a laboratory kneader. After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume. The clear toner CLT1 had a meltviscosity at 120° C. of 150 Pas.

To improve the flowability of the toner mass the toner particles were mixed with 0.5 % of hydrophobic colloidal silica particles (BET-value 130 $m^2/g$).

Clear toner 2 (CLT2)

The preparation of clear toner 1 was repeated, but instead of 100 parts of polyester P1 of Table 1, 100 parts of polyester P3 of table 1 were used. The clear toner CLT2 had a meltviscosity at 120° C. of 600 Pas.

Clear toner 3 (CLT3)

The preparation of clear toner 1 was repeated, but instead of 100 parts of polyester P1 of Table 1, 100 parts of an epoxy resin EPIKOTE 1004 (trade mark of the Shell Chemical Co) were used. The clear toner CLT3 had a meltviscosity at 120° C. of 80 Pas.

Developers

Each of the above prepared toners were used to form carrier-toner developers by mixing said mixture of toner particles and colloidal silica in a 4 % ratio with silicone-coated Cu-Zn ferrite carrier particles having an average diameter of 55 $\mu$m.

Printing Examples Full colour toner images were produced using a commercial CHROMAPRESS (a trade name of Agfa-Gevaert NV, Mortsel, Belgium). The fusing took place with radiant heat.

The images were covered with different layers of clear toner particles and with different types and amounts of silicone oils.

The scratchability of the image was visually judged and given the following quotations:

++no scratches

+scratches faintly visible when illuminated under a grazing angle.

0 scratches when illuminated under a grazing angle.

-scratches faintly visible under normal incidence of light

--scratches easily visible under normal incidence of light

The results are reported in table 3.

Printing Example 1 (PE1)

The printed full colour image was covered by the deposition of a layer of clear toner particles of CLT1. Thus the meltviscosity of the clear toner was 150 Pas whereas the meltviscosity of the coloured toner particles was 500 Pas. On top of the image NO silicone oil was applied.

Printing Example 2 (PE2)

Printing example 1 was repeated, but on top of the clear finish layer polydimethylsiloxane with viscosity at 25° C. of 50 mPas was applied in an amount of 3.0 mg/m$^2$.

Printing Example 3 (PE3)

Printing Example 2 was repeated, but the polydimethylsiloxane was applied in an amount of 200 mg/m$^2$.

Printing Example 4 (PE4)

Printing Example 2 was repeated, but the polydimethylsiloxane was applied in an amount of 400 mg/m$^2$.

Printing Example 5 (PE5)

Printing example 1 was repeated, but on top of the clear finish layer polydimethylsiloxane with viscosity at 25° C. of 2000 mPas was applied in an amount of 30 mg/m$^2$.

Printing Example 6 (PE6)

Printing example 1 was repeated, except for the application of a clear finish layer of clear toner particles CLT2, instead of a finish layer of clear toner particles CLT1 and for the application of polydimethylsiloxane with viscosity at 25° C. of 10,000 mPas on top of the clear finish layer in an amount of 30 mg/m$^2$. Thus the meltviscosity of the clear toner was 600 Pas whereas the meltviscosity of the coloured toner particles was 500 Pas.

Printing Example 7 (PE7)

The printed full colour image was covered by the deposition of a layer of clear toner particles of CLT3. Thus the meltviscosity of the clear toner was 80 Pas whereas the meltviscosity of the coloured toner particles was 500 Pas and the toner resin comprised reactive epoxy groups. On top of this image, polydimethylsiloxane comprising primary amino groups, having a viscosity at 25° C. of 10,000 mPas, was applied in an amount of 30 mg/m$^2$.

TABLE 3

| | Silicone oil | | | Finish layer | | | |
|---|---|---|---|---|---|---|---|
| Nr | Am.† | ηmPas | type* | Toner | ηPas | Scrat+ | Surf‡ |
| PE1 | 0 | n.a. | n.a. | CLT1 | 150 | -- | OK |
| PE2 | 3.0 | 50 | 1 | CLT1 | 150 | - | OK |
| PE3 | 200 | 50 | 1 | CLT1 | 150 | 0 | OK |
| PE4 | 400 | 50 | 1 | CLT1 | 150 | + | oily |
| PE5 | 30 | 2,000 | 1 | CLT1 | 150 | ++# | OK |
| PE6 | 30 | 10,000 | 1 | CLT2 | 600 | ++# | semi-gloss |
| PE7 | 30 | 10,000 | 2 | CLT3 | 80 | ++# | OK |

†amount applied on top of the image (mg/m$^2$)

*1 = polydimethylsiloxane, 2 = polydimethylsiloxane with primary amino groups

+: Scratches

‡: Surface quality high gloss

#: effect is not only greater but also lasts much longer than in PE3 and PE4

We claim:

1. A toner image fixed on a final substrate comprising a plurality of different types of fused toner particles and on top thereof a non-imagewise applied layer of an abhesive compound, said abhesive compound being present in an amount between 3.0 mg/m$^2$ and 300 mg/m2 and having a viscosity at 25° C. between 50 and 50,000 mPas wherein at least one of said different types of toner particles comprises a toner resin containing reactive groups (A) and said abhesive compound comprises reactive groups (B), reactive groups A and B being chosen such that groups A and B will react together forming a chemical bond between said fused toner particles and said abhesive compound.

2. A toner image according to claim 1, wherein said reactive groups A are members selected from the group consisting of epoxy groups, amino groups, hydroxyl groups and carboxyl groups and wherein said reactive groups B are members selected from the group consisting of amino groups, mercaptogroups, hydroxyl groups.

3. A toner image according to claim 1, wherein said abhesive compound is applied in an amount between 30 mg/m$^2$ and 150 mg/m$^2$ and has a viscosity at 25° C. between 2000 and 50,000 mPas.

4. A toner image according to claim 3, wherein said abhesive compound is a silicone oil.

5. A toner image according to claim 1, wherein said toner image further comprise on top of said plurality of different types of fused toner particles a fused layer of clear toner particles as a clear finish layer and said abhesive compound is present on top of said clear finish layer and wherein said clear toner particles forming said finish layer comprise a toner resin containing reactive groups (A) and said abhesive compound comprises reactive groups (B), reactive groups A and B being chosen such that groups A and B will react together forming a chemical bond between said fused toner particles and said abhesive compound.

6. A toner image according to claim 5, wherein said reactive groups A are members selected from the group consisting of epoxy groups, amino groups, hydroxyl groups and carboxyl groups and wherein said reactive groups B are members selected from the group consisting of amino groups, mercaptogroups, hydroxyl groups.

7. A toner image according to claim 5, wherein said clear toner particles forming said clear finish layer have at 120° C. a melt viscosity η lower than the melt viscosity η, at 120° C. of said toner particles forming said plurality of toner layers.

8. A toner image according to claim 7, wherein said toner particles forming said clear finish layer have a melt viscosity $\eta$at 120° C. such that 100 Pas$\leqq\eta\Theta$1000 Pas.

9. A toner image according to claim 5, wherein said abhesive compound is applied in an amount between 30 $mg/m^2$ and 150 $mg/m^2$ and has a viscosity at 25° C. between 2000 and 50,000 mPas.

10. A toner image according to claim 9, wherein said abhesive compound is a silicone oil.

11. A toner image according to claim 5, wherein said clear finish layer further comprises particles of metal-oxides or metal-carbonates having a diameter $\leqq 1$ $\mu$m and said abhesive compound comprises carboxyl groups.

12. A method for producing a toner image on a final substrate comprising, in consecutive order, the steps of:

i) applying, imagewise, a plurality of different toner particles on a final substrate forming a toner image, at least one of said different types of toner particles comprises a toner resin containing reactive groups (A), ii) fixing said toner particles to said substrate, forming a fused image, and iii) non-imagewise applying to said fused image a layer of an abhesive compound in an amount between 3.0 $mg/m^2$ and 300 $mg/m^2$, said abhesive compound having a viscosity at 25° C. between 50 and 50,000 mPas and carrying reactive groups (B) chosen such that groups (A) and (B) will react together forming a chemical bond between said fused toner particles and said abhesive compound.

13. A method according to claim 12, wherein said abhesive compound is applied before fixing said toner particles and said toner particles are fixed after application of said abhesive compound.

14. A method according to claim 12, wherein between the step of the imagewise application of said plurality of different types of toner particles on a final substrate, forming a toner image and the step of fixing said toner particles to said substrate, a layer of clear toner particles is applied on said image.

15. A method according to claim 12, wherein said fixing of said toner particles comprises a non-contact fusing step.

16. An apparatus for producing toner images comprising:

i) means for imagewise depositing a plurality of different types of toner particles, at least one of said different types of toner particles comprises a toner resin containing reactive groups (A), on a substrate, forming a toner image, ii) means for fixing said toner image to said substrate and iii) means for non-imagewise applying on said toner image a layer of abhesive compound in an amount between 3.0 $mg/m^2$ and 300 $mg/m^2$, said abhesive compound having a viscosity at 25° C. between 50 and 50,000 mPas and carrying reactive groups (B) chosen such that groups (A) and (B) will react together forming a chemical bond between said fused toner particles and said abhesive compound.

17. An apparatus according to claim 16, wherein said means for applying said abhesive compound are present in said apparatus before said means for fixing said toner image.

18. An apparatus according to claim 16, wherein between said means for imagewise depositing a plurality of layers of different types of toner particles on a substrate and means for fixing said toner image, means for applying a layer of clear toner particles, covering the previously applied layers, are present.

19. An apparatus according to claim 16, wherein said means for fixing said toner particles are non-contact fusing means.

20. An apparatus for producing toner images, comprising:

i) means for imagewise depositing a plurality of different types of toner particles, at least one of said different types of toner particles comprising a toner resin containing reactive groups (A), on a substrate, forming a toner image, ii) means for applying a layer of clear toner particles, covering said toner image, iii) means for fixing said toner image to said substrate by contact-fusing by an hot pressure roller, wherein silicone oil is applied to said pressure roller, said silicone having a viscosity at 25° C. between 50 and 50,000 mPas and carrying reactive groups (B) chosen such that groups (A) and (B) will react together forming a chemical bond between said fused toner particles and said abhesive compound, and iv) means for adjusting, on said toner image, said silicone oil to an amount between 3.0 $mg/m^2$ and 300 $mg/m^2$.

* * * * *

UNITED STATES PATENT AND TRADEMARK OFFICE

CERTIFICATE OF CORRECTION

PATENT NO. : 5,837,406

DATED : November 17, 1998

INVENTOR(S) : Serge Tavernier et al

It is certified that error appears in the above-indentified patent and that said Letters Patent is hereby corrected as shown below:

Column 9, line 5, "toner resin. optionally, when" should read -- toner resin. Optionally, when --, Column 9, line 11, "is, within" should read -- is within --, Column 9, line 14, "known in the are." should read -- known in the art. --, Claim 8, column 13, line 3, "that 100 Pas $\leq \eta$ ϴ 1000 Pas." should read -- that 100 Pas $\leq \eta \leq$ 1000 Pas. --.

Signed and Sealed this

First Day of June, 1999

*Attest:*

Q. TODD DICKINSON

*Attesting Officer*

*Acting Commissioner of Patents and Trademarks*